US008680984B2

(12) United States Patent
Rosen

(10) Patent No.: US 8,680,984 B2
(45) Date of Patent: Mar. 25, 2014

(54) COVERING ARRANGEMENT FOR A PIPE, AND PIPE HAVING SUCH A COVERING ARRANGEMENT

(75) Inventor: Hermann Rosen, Kastanienbaum (CH)

(73) Assignee: Rosen Swiss AG, Stans (CH)

( * ) Notice: Subject to any disclaimer, the term of this patent is extended or adjusted under 35 U.S.C. 154(b) by 187 days.

(21) Appl. No.: 13/141,486

(22) PCT Filed: Dec. 8, 2009

(86) PCT No.: PCT/EP2009/008759

§ 371 (c)(1),
(2), (4) Date: Jul. 11, 2011

(87) PCT Pub. No.: WO2010/072325

PCT Pub. Date: Jul. 1, 2010

(65) Prior Publication Data

US 2011/0260853 A1 Oct. 27, 2011

(30) Foreign Application Priority Data

Dec. 23, 2008 (DE) ..... 10 2008 063 066
Apr. 21, 2009 (DE) ..... 10 2009 017 973

(51) Int. Cl.
*G08B 1/08* (2006.01)

(52) U.S. Cl.
USPC ..... 340/539.1; 340/539.31; 340/565; 340/673

(58) Field of Classification Search
USPC ..... 340/539.1, 540, 541, 539.31, 565, 584, 340/673; 138/89, 89.4, 96 R
See application file for complete search history.

(56) References Cited

U.S. PATENT DOCUMENTS

| | | | | |
|---|---|---|---|---|
| 3,744,528 | A * | 7/1973 | Vestal | 138/89 |
| 4,095,810 | A | 6/1978 | Kulle | |
| 4,501,301 | A * | 2/1985 | Snow et al. | 138/96 T |
| 5,337,792 | A * | 8/1994 | Tempel | 138/96 R |
| 7,298,279 | B1 * | 11/2007 | Badon et al. | 340/605 |
| 7,727,593 | B2 * | 6/2010 | Zeyfang | 427/372.2 |
| 2004/0200525 | A1 | 10/2004 | Goodson | |
| 2008/0092977 | A1 | 4/2008 | Zeyfang | |

FOREIGN PATENT DOCUMENTS

| | | | |
|---|---|---|---|
| DE | 35 26 301 | A1 | 1/1987 |
| EP | 1 229 173 | A1 | 8/2002 |
| WO | 2006/102259 | A2 | 9/2006 |

* cited by examiner

*Primary Examiner* — Toan N Pham
(74) *Attorney, Agent, or Firm* — Gudrun E. Huckett

(57) ABSTRACT

Covering arrangement for a pipe which can be welded to a series of further pipes to produce pipelines intended, in particular, for transporting gaseous or liquid media, wherein the covering arrangement is designed for sealing at least the pipe edge which is at risk of corrosion, and wherein the covering arrangement comprises an inner cap with an inner sleeve which is designed for abutment against the inside of the pipe and has a covering element which is provided for the purpose of at least partially covering the inner cross section of the pipe which is not covered by the inner sleeve. The invention also relates to a pipe having a corresponding covering arrangement and a system for monitoring pipes having corresponding covering arrangements.

21 Claims, 5 Drawing Sheets

COVERING ARRANGEMENT FOR A PIPE, AND PIPE HAVING SUCH A COVERING ARRANGEMENT

BACKGROUND OF THE INVENTION

The present invention relates to a cover device for a pipe that is used with a number of other pipes, in welded-together form, for the production of pipelines, which are particularly provided for the transport of gaseous or liquid media, where the cover device is configured to seal off at least the edge of the pipe, which is at risk of corrosion, from moisture. Furthermore, the invention relates to a pipe having a corresponding cover device.

During the production of pipelines, a plurality of pipes, i.e. pipeline sections, must be protected from contamination and corrosion, particularly during storage of the pipes. The state of the art is to mount caps on the ends of the pipes, which caps cover the edges of the pipes, i.e. at least their narrow sides, which are supposed to be welded together with the edges of other pipes. If such a seal is not sufficiently provided, the pipe must be cleaned, in complicated manner, before welding. This not only results in high costs for the cleaning, but also in an interruption of pipeline construction, which might be taking place on the high seas, for example.

During transport of the pipe to the location of use, the caps are exposed to many different stresses, and can easily be removed manually and put back into place, so that an internal intervention cannot be determined simply by examining the pipe itself.

It is the task of the present invention to make a cover device for a pipe as well as a combination of a pipe and a conventional cover device more secure.

SUMMARY OF THE INVENTION

This task is accomplished by a cover device for a pipe that can be used with a number of other pipes, in welded-together form, for the production of pipelines, which are particularly provided for the transport of gaseous or liquid media, wherein the cover device is configured to seal off at least the edge of the pipe, which is at risk of corrosion, wherein the cover device comprises an inner cap having an inner sleeve configured to lie against the inside of the pipe, which sleeve has a cover element provided to at least partly cover the inner cross-section of the pipe not covered by the inner sleeve. The task is further accomplished by cover device with a holdings means and/or a pipe that can be used with a number of other pipes, in welded-together form, for the production of pipelines, which are particularly provided for the transport of gaseous or liquid media, characterized by a cover device according to the present invention.

According to the invention, it is provided to configure the cover device with an inner cap that comprises an inner sleeve configured to lie against the inside of the pipe. The cover device, which also covers at least the edge of the pipe that is at risk of corrosion, is laid into the pipe at least in part, thereby providing protection of the cover device by the pipe itself. At the same time, the inner sleeve that is to be disposed on the inside of the pipe has a cover element that is configured to at least partly cover the inner cross-section of the pipe not covered by the inner sleeve. In this way, it is effectively brought about that the end regions of the inner cap, which are situated inside the pipe, cannot be grasped and the inner cap cannot be easily pulled out of the pipe. A pipe is understood to be a hollow body, preferably having a longitudinal expanse, which does not, however, necessarily have to be configured in circular shape, but can also be configured in elliptical shape or have other cross-sectional shapes.

Preferably, the cover element is disposed at a distance from the side of the cover device that seals the edge of the pipe. The cover device, which preferably completely covers the inner cross-section of the pipe and thus also the inner cross-section of the inner sleeve, is offset toward the inside, which further counteracts damage. In particular, it is advantageous that moving the pipes by means of conventional pins that engage from the free pipe ends continues to be possible. In this connection, the inner cap of the cover device preferably consists of a sufficiently hard material, such as polyurethane, for example, with a Shore hardness A in the range of 80 to 100, particularly preferably in a range of 82 to 90, and especially around 85. Because of the placement of the cover element in an edge region of the inner sleeve, which region is preferably at a distance of at least 20, particularly more than 25, and particularly preferably approximately 30 cm from the edge of the pipe and thus from the other end of the inner sleeve, the pipe can be transported without damage to the cover device.

In another advantageous embodiment of the invention, the cover element, which completely fills the clear inner cap cross-section, is configured as a membrane open to diffusion. When installed on a pipe, the entry of water from the outer region of the pipe into the interior of the pipe is thereby prevented, while water vapor from the inside of the pipe can get out. In this connection, it is generally presupposed that corresponding cover devices are present on both sides of the pipe, or that the side that lies opposite to the cover device is closed off in some other way.

In order to make the combination of inner sleeve and cover element more secure, this element is preferably let into a collar-shaped region of the inner sleeve and thus firmly connected with it. Depending on the configuration of the single-layer or multi-layer cover element, the membrane is designed to reliably prevent damage from the outside, i.e. from the side of the pipe edge. The collar-shaped widened region, preferably on the region of the inner sleeve that is to be inserted farthest into the pipe, simultaneously serves for stabilization of the inner sleeve. This sleeve has at least one circumferential, preferably two circumferential seals along its outside, which are bent into the pipe when the inner cap is inserted into the pipe, and thus point slightly in the direction of the edge of the pipe. Particularly if one of these seals is disposed in the region of the collar-like widened region, resistance is generated by the sealing lips, which rise up if an attempt is made to pull the cap out, and this can better prevent unwanted removal of the inner cap.

In order to better allow the seal to fold over while the inner cap is pressed in, the inner sleeve preferably has a recess into which the seal can be pressed, at least in part, or into which the seal can preferably be folded, at least in part.

The inner cap has at least one holding means, preferably uniformly distributed over the circumference, on which a specially configured gripper for introducing and removing the cap can engage. Preferably, this is a flange that proceeds from the collar-shaped widened region that lies on the inside, or a region that runs completely over the circumference of the inner sleeve. A narrowing in cross-section of the inner part of the cover device is achieved by means of engagement of the gripper and contraction of the inner sleeve in the direction of its longitudinal center axis, and the adhesion friction between the pipe to be sealed and the cap is reduced, so that the cap can be removed more easily.

Furthermore, it is advantageous if the cover device has a cuff configured to lie against the pipe on the outside, which is configured to assume a sealing position with the inner cap.

The corresponding cover device is therefore configured in two parts. The cuff is particularly configured to be elastic and also lies against an outer pipe wall region, forming a seal. It serves for sealing a region of the pipe that is not coated, for example, in order to produce a weld connection. For this purpose, the cuff demonstrates a Shore hardness preferably in a range between 60 and 70, particularly about 65 Shore hardness A, which guarantees a secure fit on the pipe at a corresponding undersize of the cuff in comparison with the pipe to be covered. For example, at an undersize of about 20%, the cuff has already been shrunk on, in its position where it is applied onto the pipe, so firmly that manual removal without corresponding aids and without damaging the cuff is hardly possible any longer.

Preferably, the cuff and the inner cap are configured for assuming a sealing position, together with one another, for protecting the inside of the pipe and the regions of the pipe to be covered, i.e. particularly the regions that are essential for welding, against corrosion. For this, it is advantageous to connect the cuff and the inner cap with one another by means of a tongue-and-groove connection, where preferably, the cuff, which is preferably produced with an undersize with regard to the outer pipe diameter, has the tongue in the form of a circumferential sealing lip. This lip engages into a corresponding groove in a region of the inner cap that projects beyond the end of the pipe. This is preferably a collar-like widened region of the inner cap, which is also configured for sealing and/or covering the edge. This collar-like widened region on the one side of the inner cap, and thus subsequent to the inner sleeve, is provided with a circumferential groove on the outside. Furthermore, it covers the edge of the pipe.

It is particularly advantageous to provide a data carrier that can be read out in contact-free manner and/or written to in contact-free manner, which carrier is preferably situated on the end of the inner sleeve that faces away from the outlet or the edge of the pipe. Preferably, it is situated behind the cover element in the situation where it is inserted in a pipe, in order to be inaccessible from the outside. For example, the data carrier can be an RFID chip that contains a number of pipe data that are otherwise imprinted on the inside or outside of the pipeline. A plurality of pipes can be quickly and reliably identified with a corresponding device, with the corresponding data being directly available in digital form. At the same time, such a chip allows assignment of a specific cap to a specific pipe.

In particular, an embodiment of the invention in which the cover device has a security device for monitoring the pipe, which is particularly configured for detecting manipulations of the pipe and/or the cover device itself, is advantageous. In addition to a simple GPS transmitter, for example, such a security device is a prerequisite for guaranteeing permanent monitoring of the pipe during the entire storage period. For this purpose, the security device can be configured in such a manner that temporary removal and repositioning of the end caps can be recorded and displayed, i.e. determined. Also, the security device can be configured in such a manner that destruction of the cap by means of fire, for example, can be recorded, or for detection of pipe scraping or hammering noises, and thus physical effects on the pipe.

In particular, it is advantageous to affix the security device on the side of the cover element that is on the inside of the pipe after the cover device is placed on a pipe, and thus not accessible from the outside. The security device itself is therefore inaccessible to manual intervention, even in the event of manipulations from the outside—with the prerequisite that a pipe is covered with a cover device on both sides. Recording and passing on events, evaluating these events, and issuing an alarm signal can be brought about by means of corresponding sensors and electronics. However, this can also take place in decentralized manner, at a different location, if this location is in a communication connection, preferably a bi-directional one, with the cover device. It is also advantageous if an embodiment of the security device is hidden within the inner cap, i.e. in the material, but the function of the signal transmission means is not allowed to be restricted.

A plurality of events can be recorded with a security device that has a structure-borne sound sensor that is particularly placed directly on the pipe wall. Such a structure-borne sound sensor, preferably on a piezo-electric basis, can particularly be equipped with simple electronics for filtering out incidental sounds or preferred sounds. In this connection, drilling sounds or scraping sounds that give an indication of an attempt to remove a cuff or the inner cap, for example, can be recorded. Subsequently or at the same time, issuance of a radio signal takes place, preferably by way of a transmitter.

Likewise, it is advantageous to equip the security device with a temperature sensor that preferably issues a signal when a specific temperature, i.e. a threshold value has been reached. For example, this can be a threshold value of 80°, which indicates destruction of the inner cap by means of fire.

Mechanical cutting of the cover element or other regions of the inner cap can also be detected by means of a security device, which, in another advantageous embodiment, has a sensor to detect destruction of the cover element disposed at least in part in the cover element. Such a sensor particularly consists of a conductor loop that preferably consists of conductive adhesive and runs through the cover element and/or along it. If the conductor loop is cut, for example, destruction of the cover element is registered as the result of the accompanying potential difference, and again, an alarm signal is issued.

Preferably, the security device is configured so that it can be turned on, turned off and/or destroyed in response to a clear signal. The electronics of the inner cap, which, like the cover device as a whole, can be configured for multiple use, in particular, can therefore be turned off if necessary, for example if the inner cap has to be stored temporarily. In the event of a corresponding effect such as unauthorized removal, for example, the security device can also self-destruct after issuance of an alarm signal, so that the cap becomes at least partly unusable.

For activation of the security device, when this is in an installed position in a pipe and thus essentially no longer accessible from the outside, the inner cap can advantageously have a recess that can be used for accommodating a security element. The security element can engage into a locking mechanism of the security device, passing through the inner cap. For example, this is a chain or a rod that can be grasped from the outside and can permanently unlock the security device. Locking of the security device after activation must be precluded, in this connection. Alternatively, such activation of the security device can also take place in contact-free manner.

The recess of the inner cap is preferably disposed in the inner collar-like region that can simultaneously serve for placement of a membrane.

The advantages that belong to the cover device also belong to a pipe that is covered with a corresponding cover device, and, in particular, covered by such a device on both sides.

Furthermore, the task is accomplished by a system for monitoring pipes of the kind described in connection with the cover device of the present invention, which system is characterized by a plurality of cover devices as described, and which has a reception station for receiving the signals of the cover devices, which can preferably be passed on by means of a repeater. The signals issued by the cover devices or to be received by the cover devices can be passed on to electronic data processing, which is configured for evaluation of the signals and for issuance of an alarm signal.

Preferably, the system comprises a first control station that is disposed in the vicinity of the pipes to be monitored. In this connection, a distance from a few meters to as much as 2 km can preferably be considered close. Such a distance can easily be overcome by means of corresponding wireless connections. In a first control station, the signals queried from one or more stacks of pipes come together and are evaluated. Particularly for identifying special alarm signals of the security device, the first control station, which has the electronic data processing required for evaluating the signals, at least in part, can transmit a further alarm signal, whereupon measures can be initiated on site, if necessary. Another control station can preferably be connected by way of an Internet connection, satellite communication means, or other similar means that can be used for remote communication. This second control station can preferably be used as a main control station, which serves to control one or more first control stations, to which one or more pipe stacks are assigned, in each instance.

BRIEF DESCRIPTION OF THE DRAWINGS

Other advantages and details of the objects according to the invention can be derived from the following description of figures. The figures schematically show.

DESCRIPTION OF PREFERRED EMBODIMENTS

Parts that have the same or a similar function are provided with identical reference numbers, to the extent that this makes sense. Individual technical characteristics of the exemplary embodiments described below can also lead to further developments according to the invention, also with the characteristics of the exemplary embodiments described above.

Figure 1:
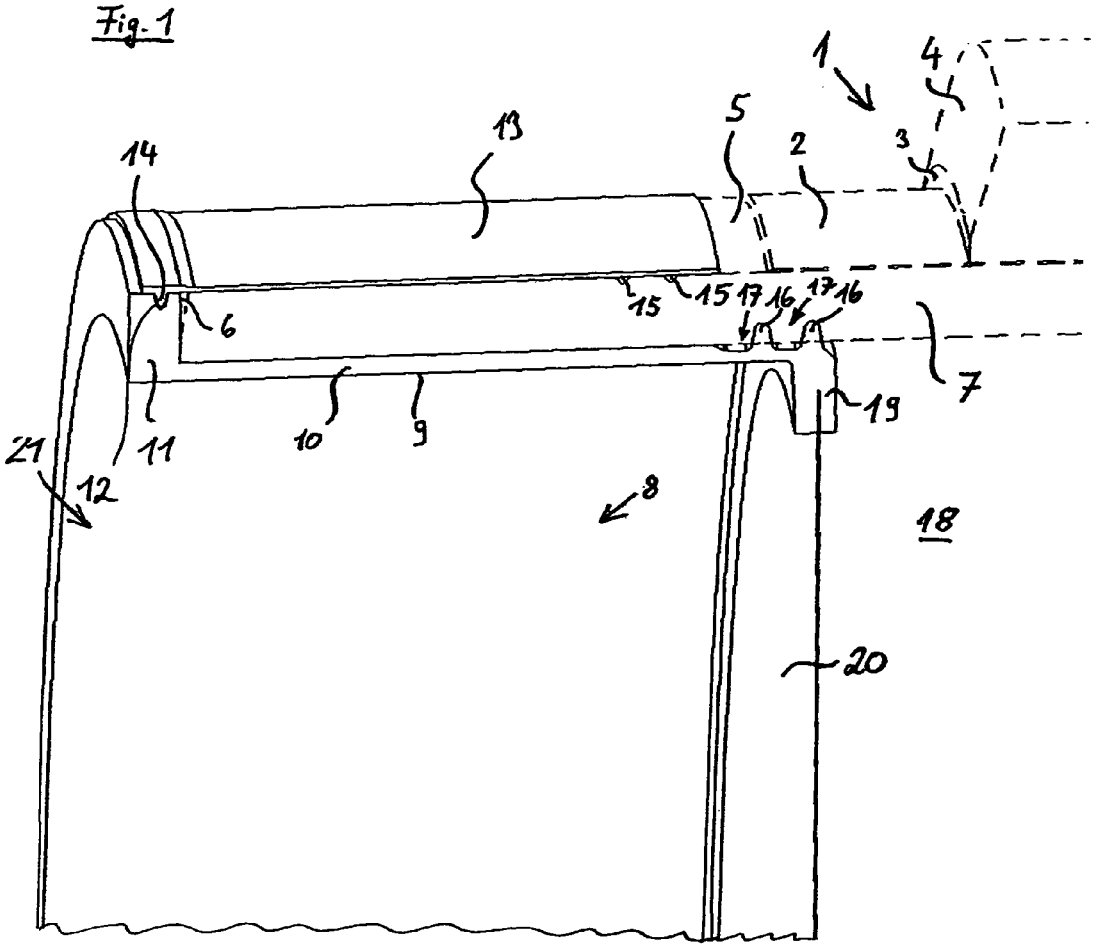
FIG. 1 a detail view of an object according to the invention.

FIG. 1 shows a detail of an object according to the invention, which can be disposed on a pipe shown with a broken line. The cover device shown, for a pipe 1, serves to cover regions 5, 6 of the pipe that are not provided with a coating 2, 3, or 4, which regions are required for welding of the pipe. In place of the region 5 that has a large area, as shown here, the region to be covered can also be merely an edge 6 of the pipe. In the following, the word pipe is therefore particularly used to mean the actual metal wall 7 of the pipe 1.

The cover device comprises an inner cap 8, which is particularly pressed into the inner cross-section of the pipe, within the pipe wall 7, using a special tool. Preferably, this inner cap consists of RoPlasthan[©], a polyurethane material that is able to withstand great stress. This material is suitable for withstanding great mechanical stresses, so that support arms for grippers provided to move the pipes, for example, can easily lie against a wall 9 of the inner sleeve 10 without causing damage to the inner cap 8. In this connection, weights of up to 30 t, for example, can be moved. Furthermore, the material is resistant to UV rays and has extremely low oxygen diffusion rates. It is therefore optimally suited for sealing the regions of the pipe 1 that are at risk of corrosion, particularly the edge 6, to protect them against moisture.

To cover the edge 6, a collar-like widened region 11 is particularly provided, which simultaneously serves to stabilize the inner cap 8. The widened region is preferably about as tight [sic—"dicht" should probably be "dick"=thick] as the edge 6 of the pipe wall 7 is wide. On its outer side, corresponding to the pipe surface 5, it has a groove 12 that serves for a connection with a cuff 13. For a connection with the inner cap 8, the cuff 13 has a tongue-like sealing lip 14 that engages into the groove 12 when the cuff 13 is shrunk onto the outside of the pipe, i.e. the surface 5, with precise fit. Because of the precise fit of the cuff 13, which is produced from an elastic but very robust material, preferably also from RoPlasthan[©], good sealing of the region to be protected is achieved. Preferably, for this purpose the cuff 13 has two more sealing lips 15 on the side to be disposed away from the edge 6, which prevent capillary entry of water into the interstice between the inside of the cuff 13 and the pipe wall surface 5.

The two sealing lips 16 of the inner sleeve 8 [sic—should be 10] have the further function, in addition to their sealing function, of making it difficult to pull the inner cap 8 out. For this purpose, the sealing lips 16 are pressed into the recesses 17, at least in part, after introduction into a pipe 1, and attempt to straighten up into the position shown in FIG. 1 because of the friction adhesion on the inside 18 of the pipe wall. As a result, a greater resistance is generated, because the inner sleeve 8 [sic—should be 10] is configured in stable manner, particularly due to the collar-like widened region 19, and prevents the sealing lips 16 from straightening up. A membrane 20 open to diffusion is let into the collar-like widened region 19, which is to be disposed at a distance from the edge 6, for example at a distance of approximately 30 cm, which membrane allows a gas exchange and therefore drying out of the inner region of the pipe, but which prevents mechanical intervention in the [word missing] of the edge 6. Liquid water also cannot get into the protection region of the pipe 1 from the side of the opening 21.

Figure 2:
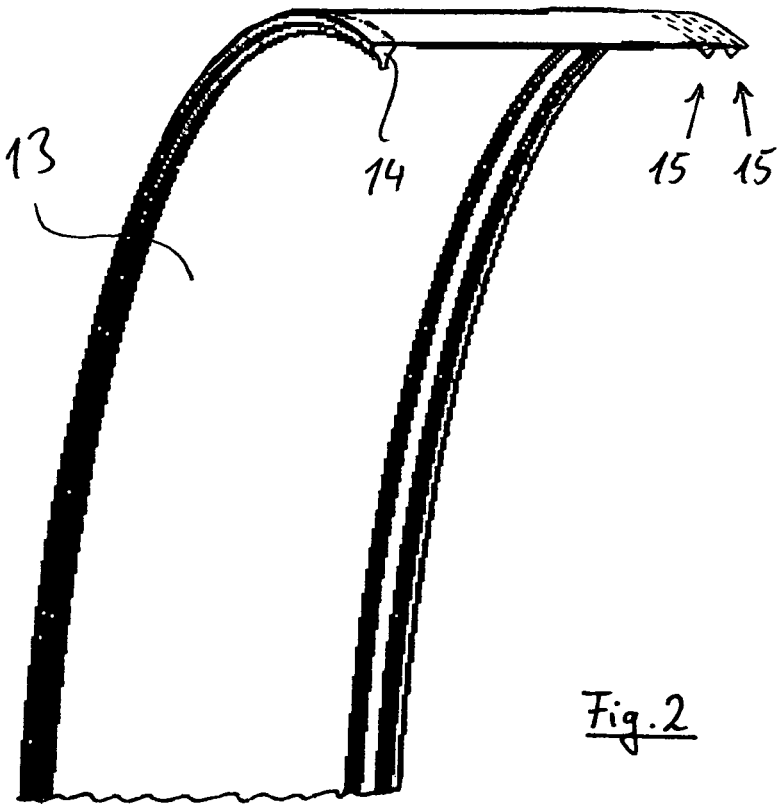
FIG. 2 another detail of an object according to the invention.

The longitudinal section of the cuff 13, a detail of which is shown in FIG. 2, once again shows the sealing lips 15 that run on the inside of the cuff. Also, the circumferential sealing lip 14 is shown. Outside of the sealing lips, the material has a thickness between 1 mm and 5 mm, and can furthermore have and enclose additional O-rings or other sealing means.

Figure 3:
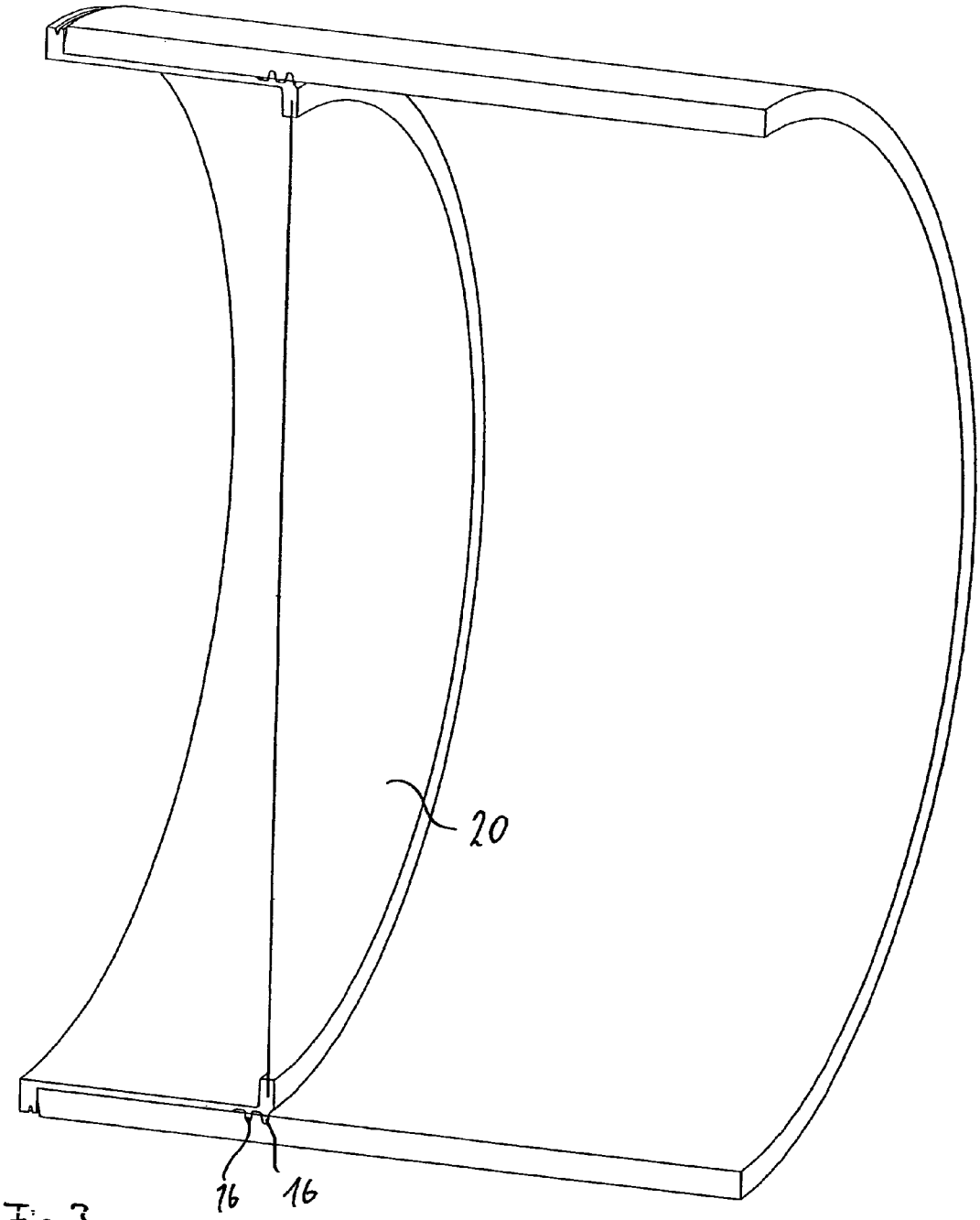
FIG. 3 another detail view of an object according to the invention.

The longitudinal section according to FIG. 3 shows the cover device without a cuff. Depending on the region to be covered, the cover device can therefore also be formed solely by the inner cap 8. In this exemplary embodiment, the cover element, i.e. the membrane 20 has a water vapor permeability of less than 0.05 m, a tensile stress resistance of more than 300 N/50 mm, and a tear resistance of more than 300 N. It can be used in a range between −50° and +120°, and has a watertightness of more than 2 m water column. Furthermore, it is UV resistant for more than three years. In the embodiment shown, the cap with pipe is merely shown as a mechanical sealing element. Securing of the cap takes place only by way of the sealing lips 16, which are not shown pressed in and turned, and prevent the cap from being pulled out, at least in part.

Figure 4:
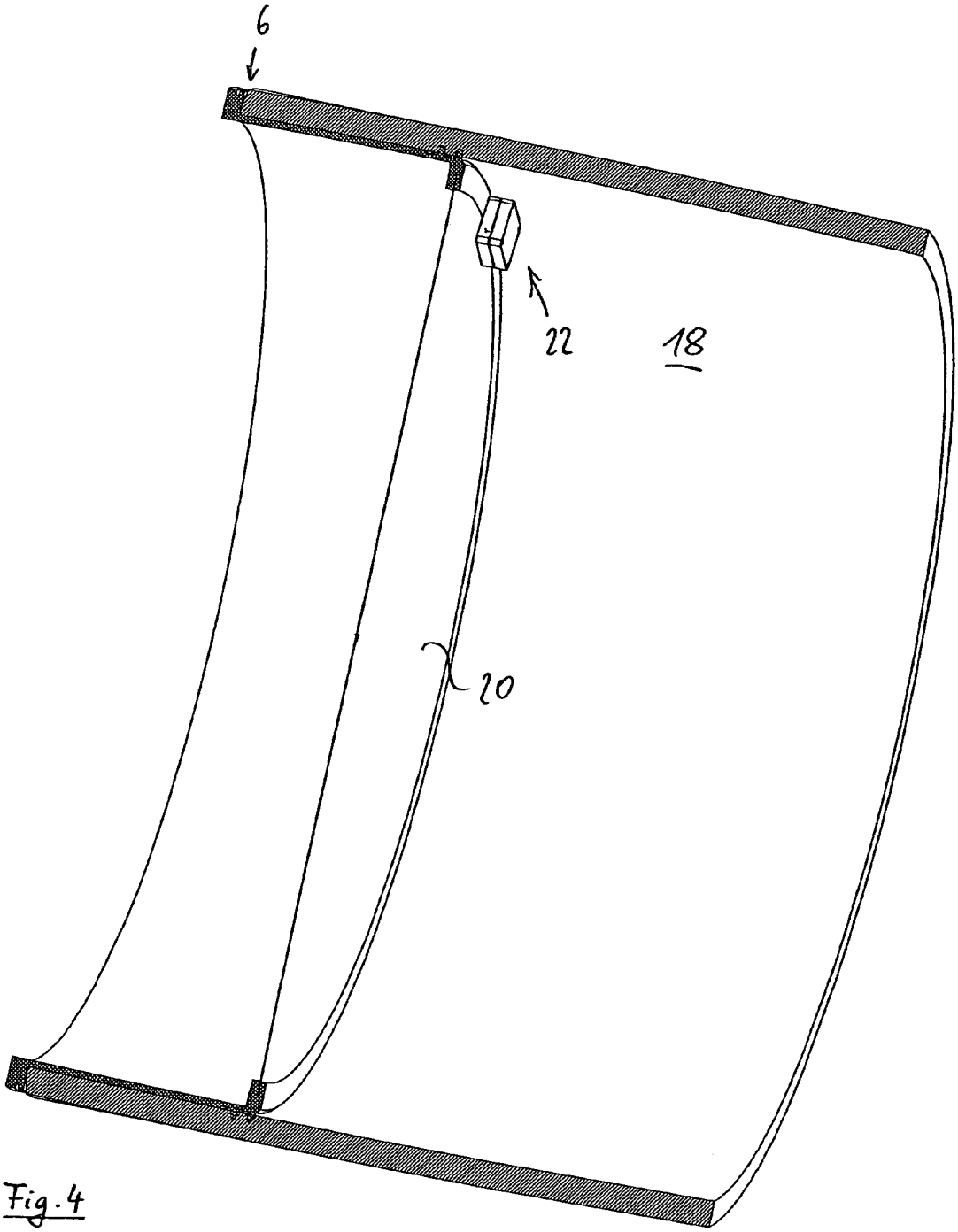
FIG. 4 a detail view of another object according to the invention.

In an embodiment according to FIG. 4, the cover device according to the invention is furthermore provided with a security device 22 that is disposed on the inside 18 of the pipe wall, at least with a structure-borne sound sensor not shown in any detail here. The security device 22 has electronics that can pass a signal on to a corresponding base station, by way of a transmitter disposed in the membrane, for example. For this purpose, the signal generated by a structure-borne sound sensor can first be filtered within the security device, according to amplitude, frequency, and length. An energy storage unit, preferably a rechargeable one, serves as the power supply for the security device; this unit can keep energy available for a sufficiently long period of time over the transport periods of the pipe to its location of use, if the latter is closed off with the cap.

The security device is disposed on the side of the membrane that faces away from the edge 6 of the pipe, and is therefore in a region protected by the membrane 20.

Furthermore, the security device has an RFID tag in its housing, in the memory of which tag a pipe number can be stored by means of a read/write device. In this connection, the pipe number can be read from the inner wall of the pipe by the device, which is preferably also configured as a scanner, and directly transmitted to the RFID tag.

Figure 5:
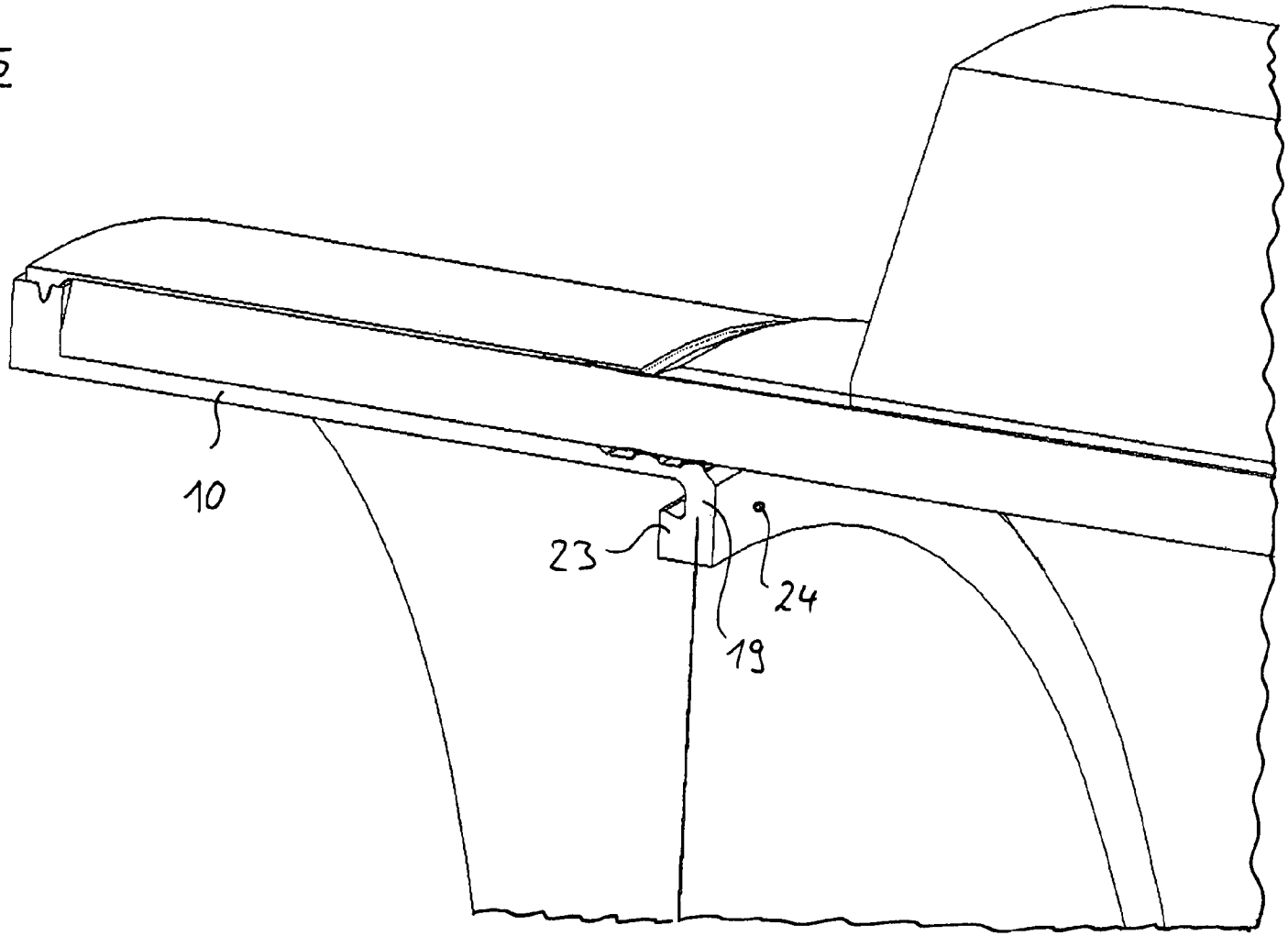
FIG. 5 a detail view of another object according to the invention.

The embodiment of a cover device according to the invention shown in FIG. 5 has an inner cap that has a holding means 23 in the form of a flange, disposed on the collar-like widened region 19 to be disposed on the inside of the pipe, supplemental to the exemplary embodiment described above under FIG. 1. A gripper can engage on this holding means for installation or removal of the cover device, and can narrow the inner cap, together with the sleeve, in cross-section. For this purpose, the flange 23 is pulled in the direction of the longitudinal center axis. Because of the slight undercut of the flange 23, a gripper can better engage on the flange.

A security device, not shown in any greater detail, can be activated through a recess 24, by means of removing a security element to be disposed partly in the recess 24. The pipe, which can also be seen in the figure, can be part of an object according to the invention.

What is claimed is:

1. Cover device for a pipe (1) that can be used with a number of other pipes, in welded-together form, for producing pipelines, which are particularly provided for transporting gaseous or liquid media, wherein the cover device is configured to seal off at least an edge (6) of the pipe (1), which is at risk of corrosion, wherein the cover device comprises an inner cap (8) having an inner sleeve (10) configured to lie against an inside (18) of the pipe, which sleeve has a cover element (20) provided to at least partly cover an inner cross-section of the pipe not covered by the inner sleeve (10), wherein the cover device comprises a cuff (13) embodied separate from the inner cap (8) and configured to make outer contact with the pipe (1), wherein the cuff (13) is configured to attach seal-tightly to the inner cap (8).

2. Cover device according to claim 1, wherein the cover element is disposed at a distance from a side of the cover device that seals the edge (6) of the pipe (1).

3. Cover device according to claim 1, wherein the cover element (20) that completely fills a clear cross-section of the inner cap is configured as a membrane open to diffusion.

4. Cover device according to claim 3, wherein the cover element (20) is let into a region (19), preferably a collar-shaped region, of the inner sleeve (10).

5. Cover device according to claim 1, wherein the inner sleeve (10) has at least one circumferential seal (16) on an outside.

6. Cover device according to claim 5, wherein the seal (16) has a recess (17) of the inner sleeve (10) assigned to it, into which the seal (16) can be pressed, at least in part.

7. Cover device according to claim 1, wherein the cuff (13) has at least one inner and circumferential seal (15).

8. Cover device according to claim 1, wherein the inner cap comprises a collar-like widened region (11) covering the edge (6) of the pipe (1) and wherein the cuff engages seal-tightly the collar-like widened region.

9. Cover device according to claim 8, wherein the collar-like widened region has a circumferential groove and the cuff has a circumferential sealing lip engaging seal-tightly the circumferential groove.

10. Cover device according to claim 1, comprising a data carrier that can be read in contact-free manner and/or written to in contact-free manner.

11. Cover device according to claim 1, comprising a security device (22) for monitoring the pipe (1), which is preferably configured to detect manipulations of the pipe (1) and/or the cover device.

12. Cover device according to claim 11, wherein the security device (22) is disposed on the side of the cover element (20) facing away from the edge (6) of the pipe (1) and/or integrated into the inner cap (8).

13. Cover device according to claim 11, comprising a structure-borne sound sensor.

14. Cover device according to claim 11, wherein the security device (22) has a temperature sensor.

15. Cover device according to claim 11, wherein the security device (22) comprises cutting security disposed in the cover element (20), at least in part.

16. Cover device according to claim 11, wherein the security device (22) has a transmitter for issuing a radio signal.

17. Cover device according to claim 11, wherein the security device (22) is configured so that it can be turned on, shut off and/or destroyed in response to a clear signal.

18. Cover device according to claim 1, comprising a holding means (23).

19. Pipe that can be used with a number of other pipes, in welded-together form, for the production of pipelines, which are particularly provided for the transport of gaseous or liquid media, comprising a cover device according to claim 1.

20. System for monitoring pipes, comprising a plurality of cover devices according to claim 1 with a security device having a transmitter for issuing a radio signal, the system having a receiving station for reception of the radio signals of the cover devices, which can preferably be passed on by means of a repeater, and having electronic data processing that is configured for evaluating the signals and for issuing an alarm signal.

21. System according to claim 20, comprising a first control station that comprises the electronic data processing, at least in part, and a second control station that is disposed at a distance from and connected with the first control station, by way of communication means that are preferably configured as an Internet connection.

* * * * *